US008172486B2

(12) United States Patent
Wang

(10) Patent No.: US 8,172,486 B2
(45) Date of Patent: May 8, 2012

(54) ENGINEERING-PURPOSE NETTED VEGETATION BLANKET

(75) Inventor: Yi-Hui Wang, Taipei (TW)

(73) Assignee: Seven States Enterprise Co., Ltd., Taoyuan Hsien (TW)

( * ) Notice: Subject to any disclaimer, the term of this patent is extended or adjusted under 35 U.S.C. 154(b) by 198 days.

(21) Appl. No.: 12/585,318

(22) Filed: Sep. 11, 2009

(65) Prior Publication Data

US 2011/0064528 A1 Mar. 17, 2011

(51) Int. Cl.
*E02D 17/20* (2006.01)

(52) U.S. Cl. ..... 405/302.6; 405/16; 405/302.7

(58) Field of Classification Search ..... 405/16, 405/17, 302.4, 302.6, 302.7; 428/107
See application file for complete search history.

(56) References Cited

U.S. PATENT DOCUMENTS

| | | | | |
|---|---|---|---|---|
| 6,305,875 | B1 * | 10/2001 | Matsumoto | 405/16 |
| 7,056,058 | B2 * | 6/2006 | Urriola et al. | 405/43 |
| 2004/0234725 | A1 | 11/2004 | Chiang | |
| 2006/0233611 | A1 * | 10/2006 | Li | 405/15 |
| 2007/0269275 | A1 * | 11/2007 | Kimberlin | 405/302.6 |

FOREIGN PATENT DOCUMENTS

TW M249977 U 11/2004

* cited by examiner

*Primary Examiner* — David Bagnell
*Assistant Examiner* — Benjamin Fiorello
(74) *Attorney, Agent, or Firm* — Rosenberg, Klein & Lee

(57) ABSTRACT

An engineering-purpose netted vegetation blanket including a plurality of mesh units arrayed and interwoven into rows. The mesh units each have borders loop-knitted using threads to form a double-layer structure including an upper and a lower thread layer, and a plurality of curved threads that are so woven to locate between the upper and the lower thread layer and be sequentially arrayed and extended between two adjacent ones of the borders while protruding from a plane defined by the borders. The mesh units are so arrayed that the mesh units in any two adjacent rows are in staggered relation, such that a void is formed between any two adjacent mesh units.

3 Claims, 8 Drawing Sheets

ENGINEERING-PURPOSE NETTED VEGETATION BLANKET

FIELD OF THE INVENTION

The present invention relates to an engineering-purpose netted vegetation blanket, and more particularly to an engineering-purpose netted vegetation blanket for effective soil and water conservation as well as prevention of slope soil erosion and wash-away of grass and plants to thereby achieve the purpose of greening environment.

BACKGROUND OF THE INVENTION

In recent years, people pay more attention to ecological resources and scenery quality. Therefore, when public constructions, such as the construction of roads, river banks, landfill fields, retaining walls, etc., have connection with slope stabilization, vegetation, soil and water conservation and environmental conservation, it is a must the slope stabilization function and the safety in use be taken into consideration in these public constructions, so that natural, green and beautiful scenery can be created after the public constructions are completed. In the past, to avoid destruction of the ecological environment and adverse influences on the natural scenery at the construction sites, and to create natural scenery in harmony with the existing environment, the ecology and environment-related public constructions would usually adopt planting methods to green the construction sites, so as to create an environment in harmony with the nature.

In the conventional slope protection constructions, the riverbank protection constructions, and the soil and water conservation constructions, a netted vegetation blanket is spread on the earth surface after grass and plant seeds are sown or sprayed, and the netted vegetation blanket is further covered with soil. By doing so, plants and grass grown on the slopes are protected against undesirable wash-away by rainwater, and soil at the slopes is protected against erosion to ensure good soil and water conservation and greening of surrounding environment.

According to one of the conventional netted vegetation blankets, the blanket has three layers, including an upper grid layer, a middle fiber layer, and a lower grid layer. The conventional three-layer netted vegetation blanket has relatively low porosity, which prevents plant and grass seeds below the spread blanket from growing upward and passing through the blanket. Further, the conventional three-layer netted vegetation blanket has relatively loose layered structure, and the upper and lower grid layers are not a three-dimensional structure. As a result, the grass seeds sown or spray-planted below the blanket are easily washed away by rainwater during the construction. The poor vegetation effect in turn causes erosion of soil spread over the blanket. Further, the middle fiber layer is usually formed from natural fibers, which are subject to damage by worms to thereby weaken the overall structural strength of the netted vegetation blanket. Therefore, the conventional three-layer netted vegetation blanket requires improvement.

FIG. 1 shows another conventional netted vegetation blanket disclosed in Taiwan Patent Publication No. M249977, which is characterized in a blank blanket 10 woven from a low-shrinkage yarn, and a plurality of ribs 11 made of high-shrinkage yarns. The ribs 11 are axially extended to space from one another, and are provided on the same side of the blank blanket 10 by way of partially weaving onto the blank blanket 10. With the ribs 11 spaced on and partially woven to the blank blanket 10, a plurality of interwoven locations 12 and a plurality of non-interwoven locations 13 are formed on the blank blanket 10. The blank blanket 10 with the ribs 11 is then heated and the ribs 11 are shrunk to form a plurality of corrugations 14 on the blank blanket 10. The above netted vegetation blanket disclosed in Taiwan Patent Publication No. M249977 has the following major disadvantage: the corrugations 14 are formed by heating and shrinking the blank blanket 10 and the ribs 11, and have low flexibility and elasticity. It is preferable a netted vegetation blanket can be wound into roll form for convenient storage and transport and be stretched for use. However, the corrugations 14 will become deformed and no longer have a three-dimensional shape once the netted vegetation blanket is wound. The deformed corrugations 14 lose their intended function to thereby lower the performance and effect of the netted vegetation blanket. Moreover, with the fixedly shaped corrugations 14, the blanket wound into roll form would become too loose to be easily handled during transporting.

It is therefore desirable to develop an improved netted vegetation blanket to overcome the drawbacks in the conventional netted vegetation blankets.

SUMMARY OF THE INVENTION

A primary object of the present invention is to provide an engineering-purpose netted vegetation blanket that includes a plurality of double-layer mesh units having borders formed by loop knitting, so that the netted vegetation blanket has good structural strength, ductility, softness and flexibility to allow stretching in both longitudinal and transverse directions.

Another object of the present invention is to provide the above engineering-purpose netted vegetation blanket, in which the mesh units each have a plurality of thin threads being sequentially arrayed and extended between two adjacent ones of the borders while protruding from a plane defined by the borders, so that the soft but densely distributed curved thin threads are helpful in good attachment of grass and plants and soil to the netted vegetation blanket.

A further object of the present invention is to provide the above engineering-purpose netted vegetation blanket, in which the mesh units in two adjacent rows are arrayed in staggered relation, so that a void is formed between any two adjacent mesh units, allowing grass and plants to grow and easily pass through the blanket to absorb fertilizer and sunlight via the voids.

A still further object of the present invention is to provide the above engineering-purpose netted vegetation blanket that can be properly adjusted in the shape and size of the voids and the protrusion of the curved thin threads on the blanket according to the terrain and the soil nature of the construction site, so as to enable good retaining of compost and reduction of soil erosion while conducting spray planting, particularly on slopes.

A still further object of the present invention is to provide the above engineering-purpose netted vegetation blanket that has good flexibility and elasticity and can therefore be wound into roll form to facilitate convenient storage, transport and spreading over the earth surface.

In brief, the engineering-purpose netted vegetation blanket according to the present invention includes a plurality of arrayed and interwoven mesh units. The mesh units each have borders formed by loop knitting using thick threads to thereby create a double-layer structure having an upper and a lower thick-thread layer and serve as a framing structure. And, a plurality of thin threads is located between the two layers and so woven to extend between two adjacent ones of the borders, forming a plurality of curved thin threads protruded from a plane defined by the borders. And, the mesh units are so arrayed that the mesh units in two adjacent rows are in staggered relation, and accordingly, a void is formed between any two adjacent mesh units.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
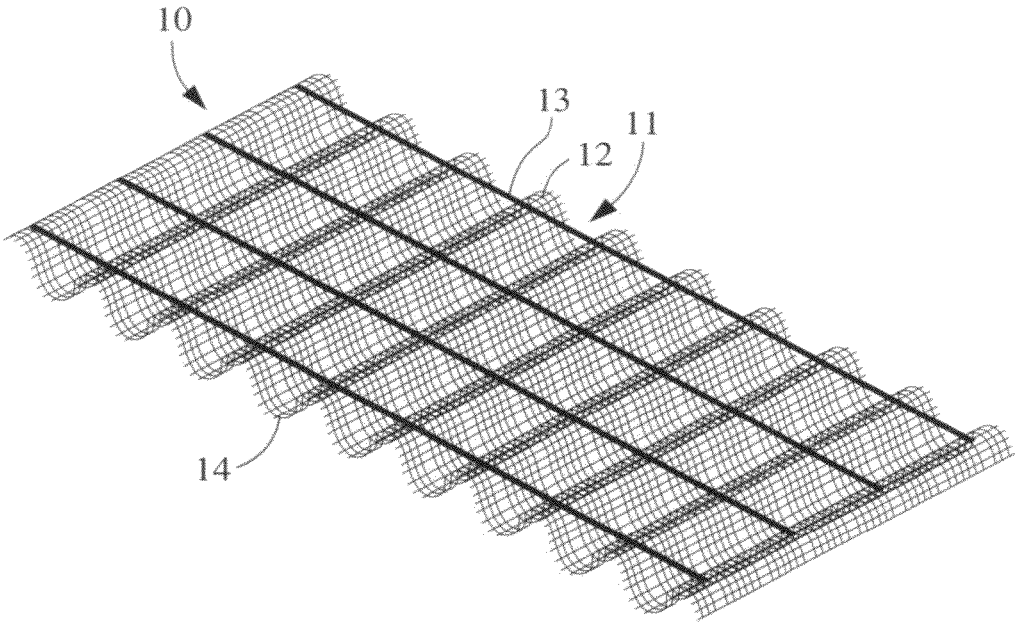
FIG.1 PRIOR ART
FIG. 1 is a, perspective view of a conventional netted vegetation blanket disclosed in Taiwan Patent Publication No. M249977.
Figure 2:
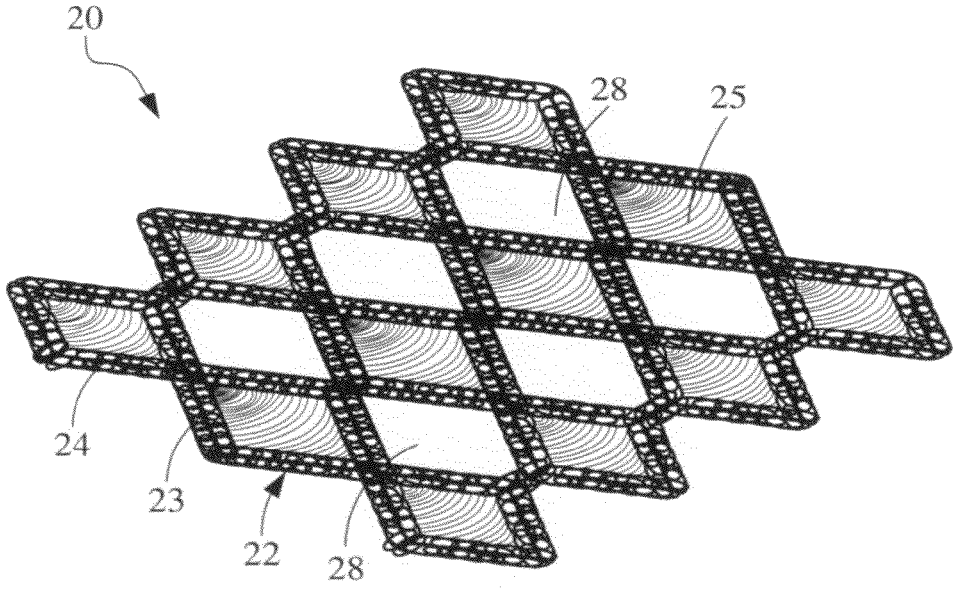
FIG. 2 is a fragmentary isometric view of an engineering-purpose netted vegetation blanket according to an embodiment of the present invention.
Figure 8:
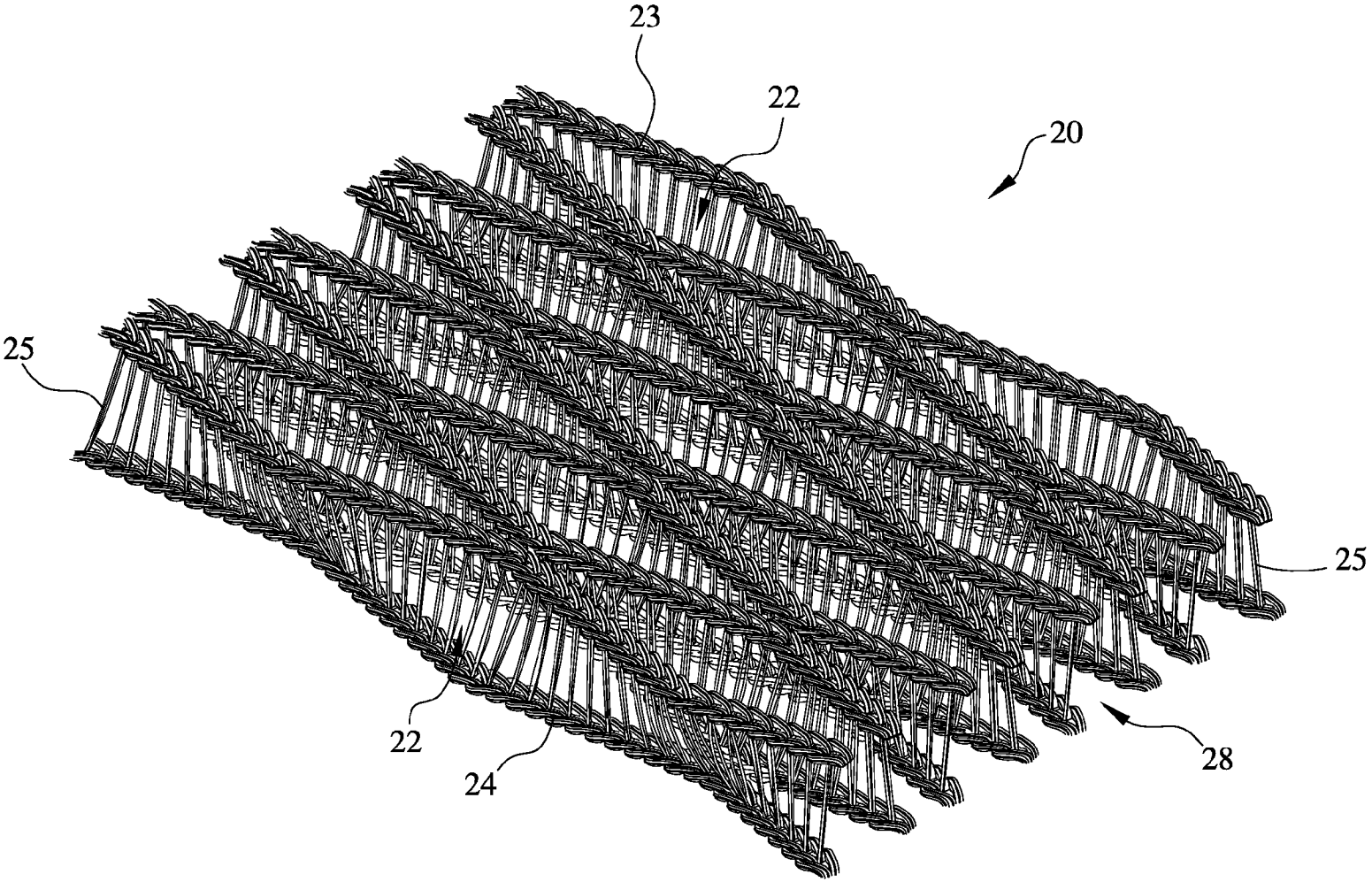
FIGS. 8-10 show alternative mesh-unit shapes for the inventive engineering-purpose netted vegetation blanket.
Figure 9:
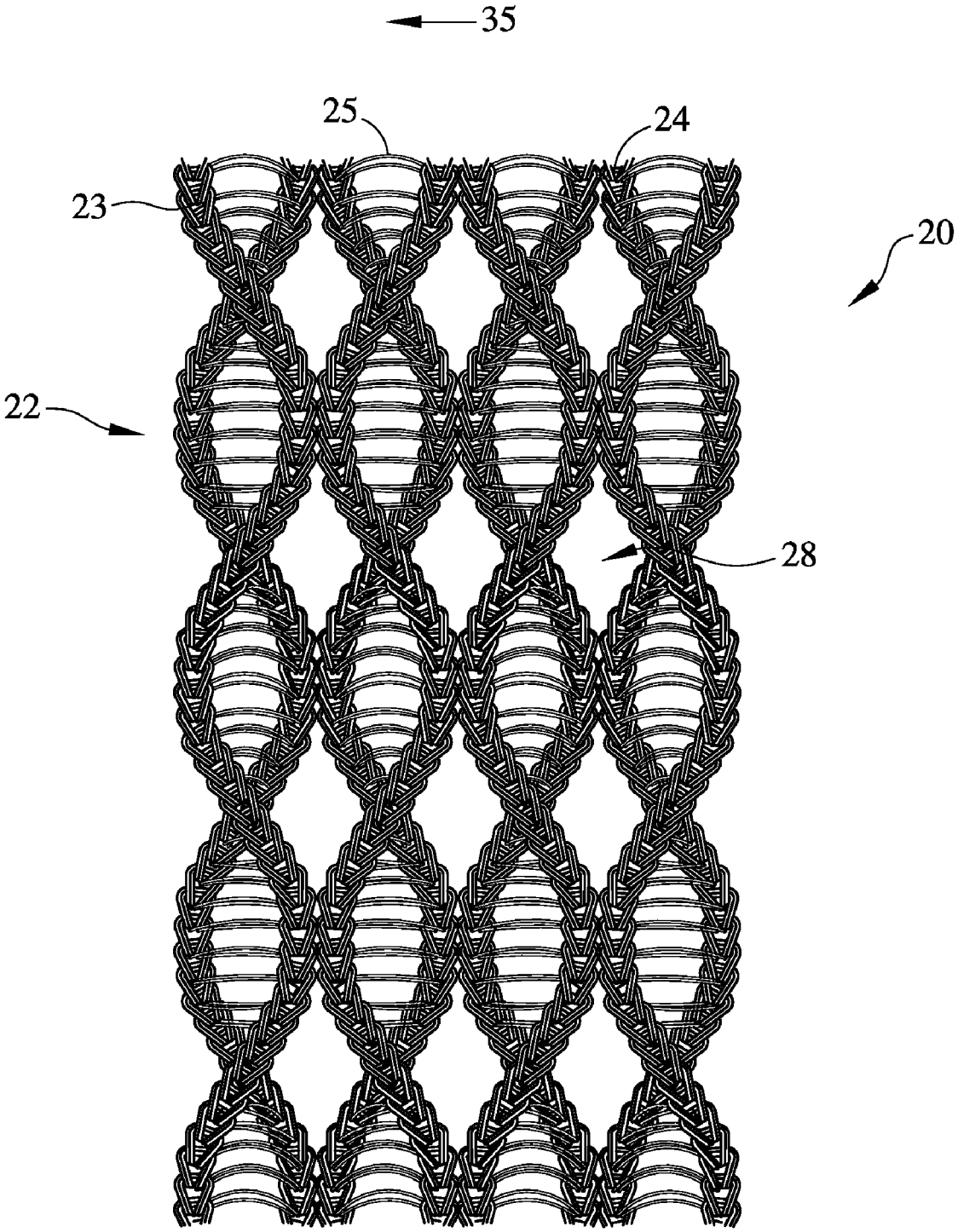
Figure 10:
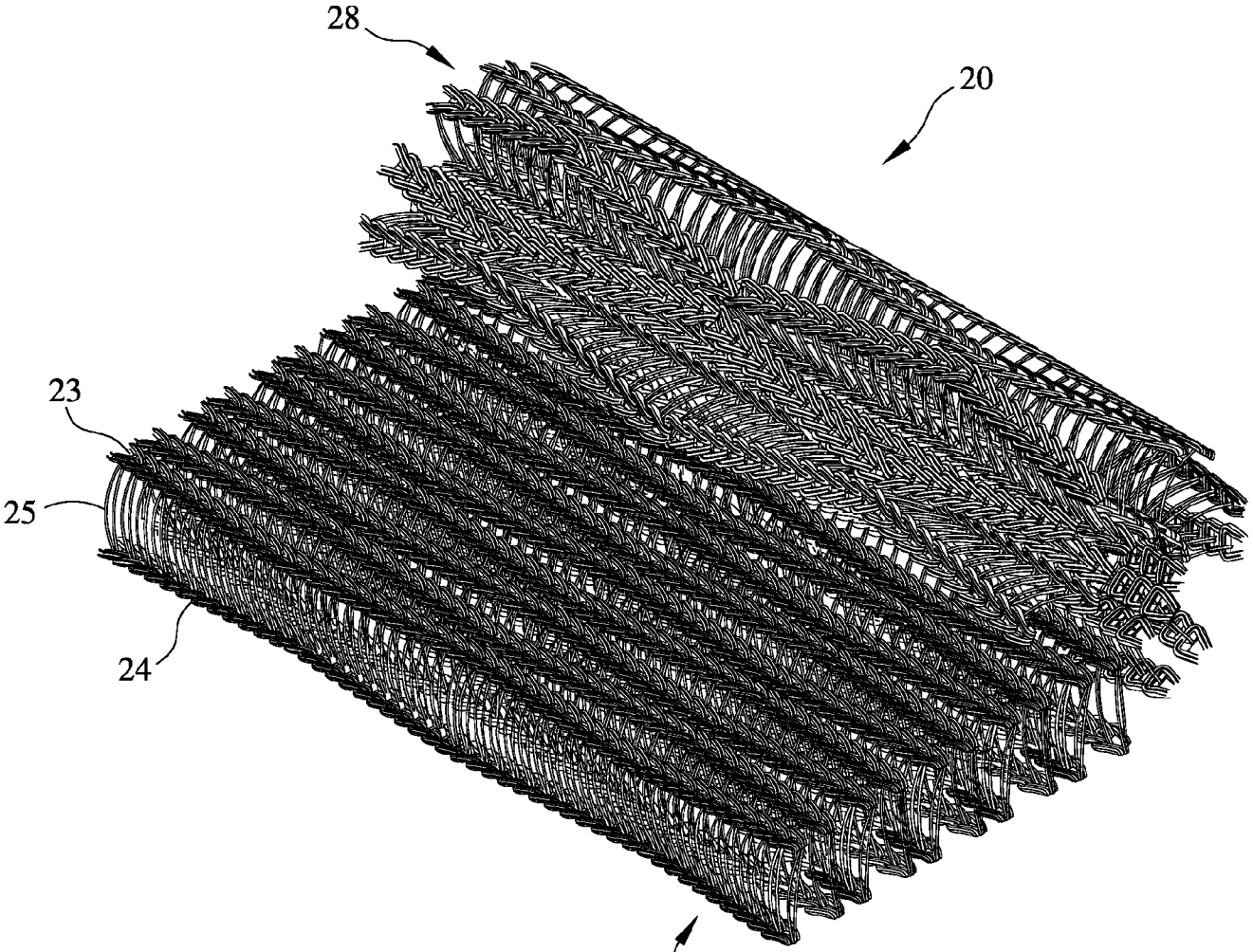

Please refer to FIG. 2 that is an isometric view of an engineering-purpose netted vegetation blanket 20 according to an embodiment of the present invention. For the purpose of conciseness, the present invention is also briefly referred to as "the netted vegetation blanket" herein. As shown, the netted vegetation blanket 20 is formed from a plurality of arrayed and interwoven mesh units 22. The mesh units 22 each can be round or rectangular in shape or in any other geometrical shapes, as seen in FIGS. 8, 9, and 10. In the illustrated embodiment, the mesh units 22 each are in a rectangular shape. Each of the mesh units 22 has four borders formed by loop knitting. And, in each of the mesh units 22, there is a plurality of curved thin threads 25. These curved thin threads 25 are so woven that they are sequentially arrayed to extend between two pairs of adjacent borders and protrude from a plane defined by the borders. Further, the mesh units 22 are so arrayed that the mesh units 22 in any two adjacent rows are in staggered relation, such that a void 28 is formed between any two adjacent mesh units 22.

Figure 3:
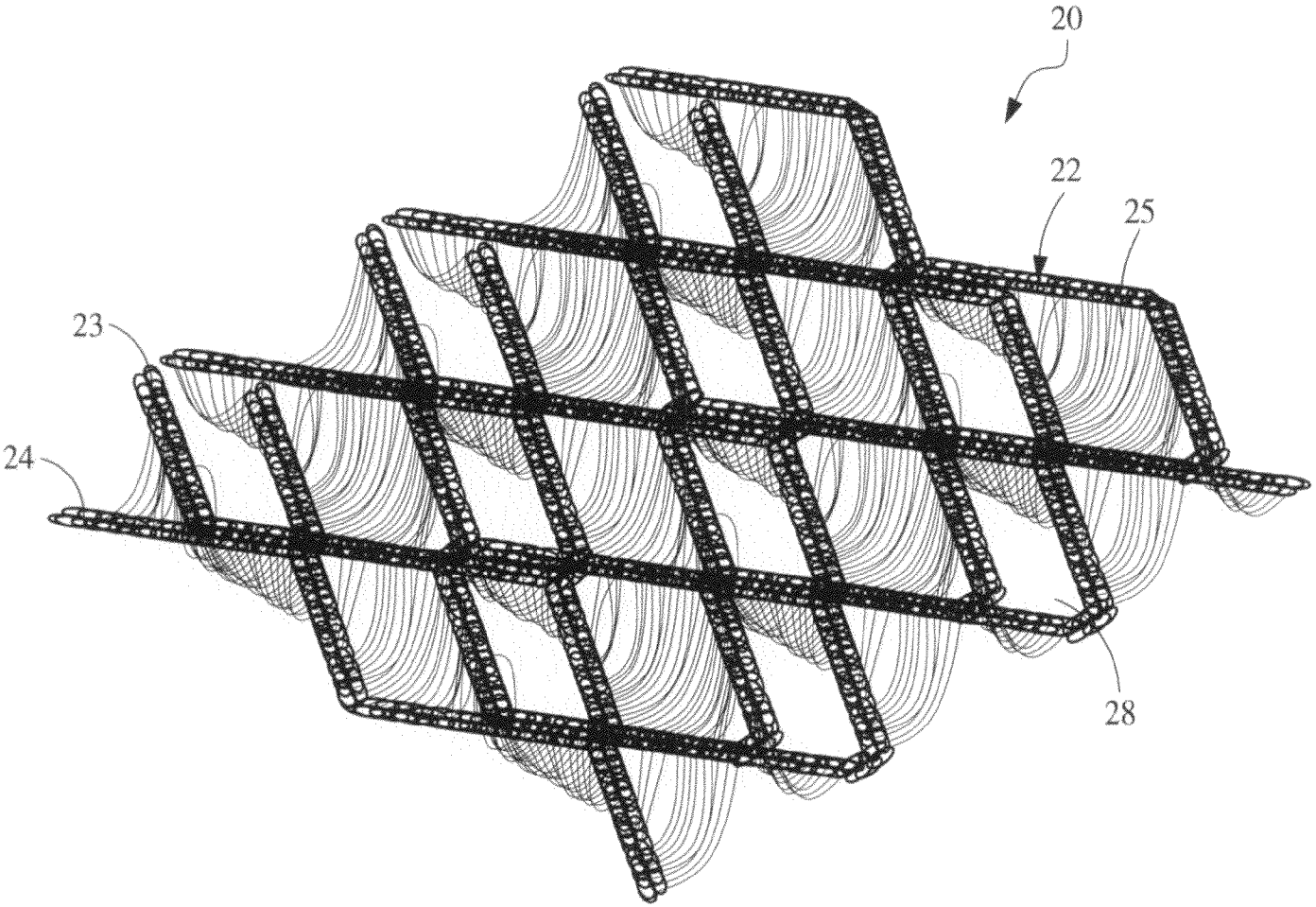
FIG. 3 is a fragmentary perspective view of the engineering-purpose netted vegetation blanket of FIG. 2.
Figure 7:
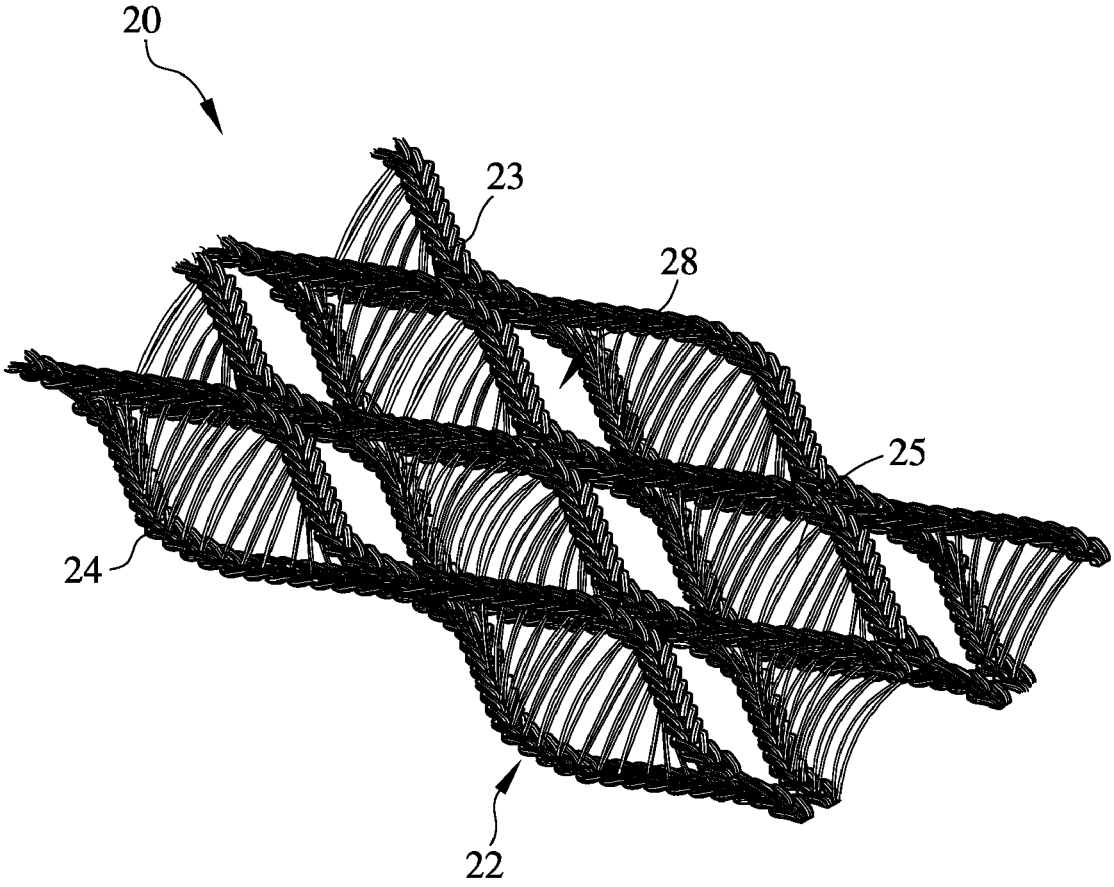
FIG. 7 is an alternative illustration of the engineering-purpose netted vegetation blanket according to an embodiment of the present invention as depicted in FIG. 3.

Please refer to FIGS. 3 and 7 that are fragmentary perspective views of the engineering-purpose netted vegetation blanket 20. As shown, the borders of the mesh units 22 are knitted using thick threads to form a double-layer structure including an upper thick-thread layer 23 and a lower thick-thread layer 24, so that the borders of the mesh units 22 function as a structural frame. Further, as can be seen from FIG. 3, the borders of the mesh units 22 are formed by loop knitting and the curved thin threads 25 are protruded from the plane defined by the borders of the mesh units 22. Further, the sequentially arrayed curved thin threads 25 are flexible and elastic, and produce an opening between any two adjacent thin threads 25, allowing sown seeds below the netted vegetation blanket 20 to grow and pass through the openings among the curved thin threads 25 while being supported by the latter. The threads for knitting the mesh units can be yarn threads, PE threads, HDPE threads, or threads made of other suitable materials.

Figure 4:
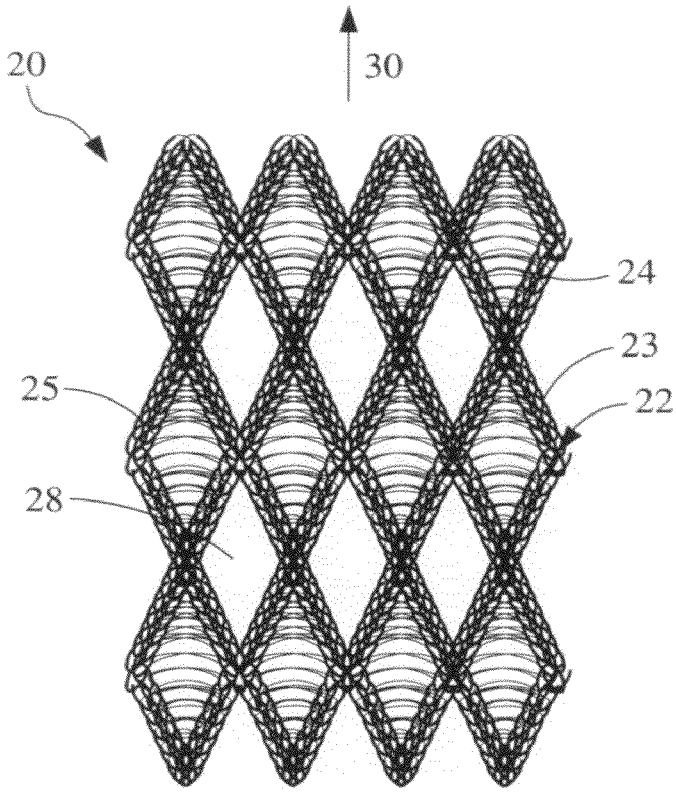
FIG. 4 shows the engineering-purpose netted vegetation blanket of the present invention is longitudinally stretched while being spread over the earth surface.
Figure 5:
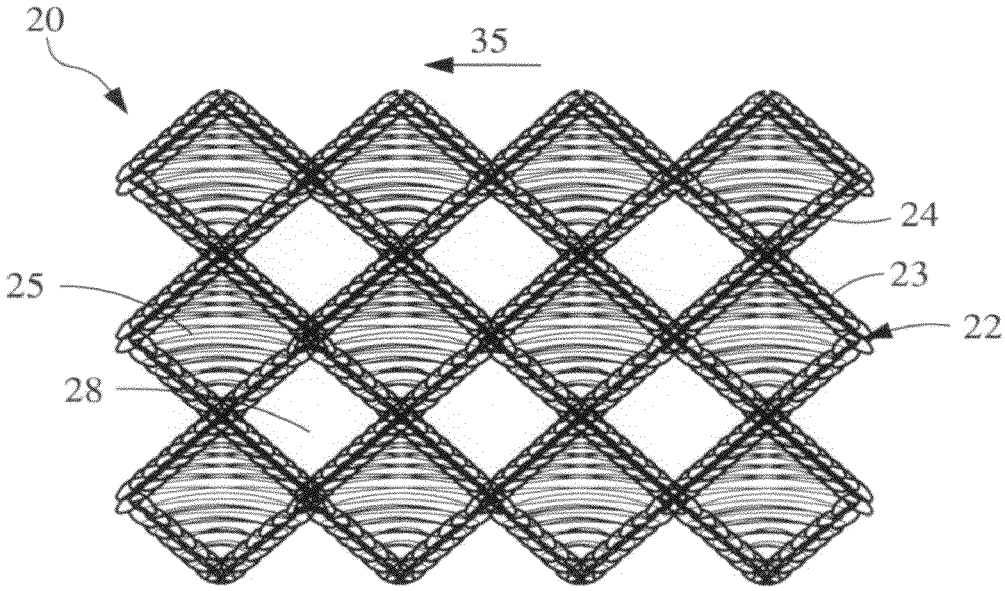
FIG. 5 shows the engineering-purpose netted vegetation blanket of the present invention is transversely stretched while being spread over the earth surface.

FIGS. 4 and 5 show the netted vegetation blanket 20 of the present invention in a longitudinally and a transversely stretched state, respectively, when being spread over the earth surface. To meet the geographic profile of a slope, an embankment, or any other construction site, the engineering-purpose netted vegetation blanket 20 is often stretched or tensioned in a required direction to be optimally spread over the earth surface. With the borders of the mesh units 22 being formed by loop knitting, which provides good elastically restoring force, the netted vegetation blanket 20 formed from the mesh units 22 can be stretched in a longitudinal direction as indicated by the arrow 30 in FIG. 4 and/or in a transverse direction as indicated by the arrow 35 in FIG. 5. When the netted vegetation blanket 20 is longitudinally stretched, the mesh units 22 are deformable into longitudinally extended units. Alternatively, when the netted vegetation blanket 20 is transversely stretched, the mesh units 22 are deformable into transversely extended units. With the flexibility thereof, the mesh units 22 can fully meet the requirement of being used in different geographical environments.

Figure 6:
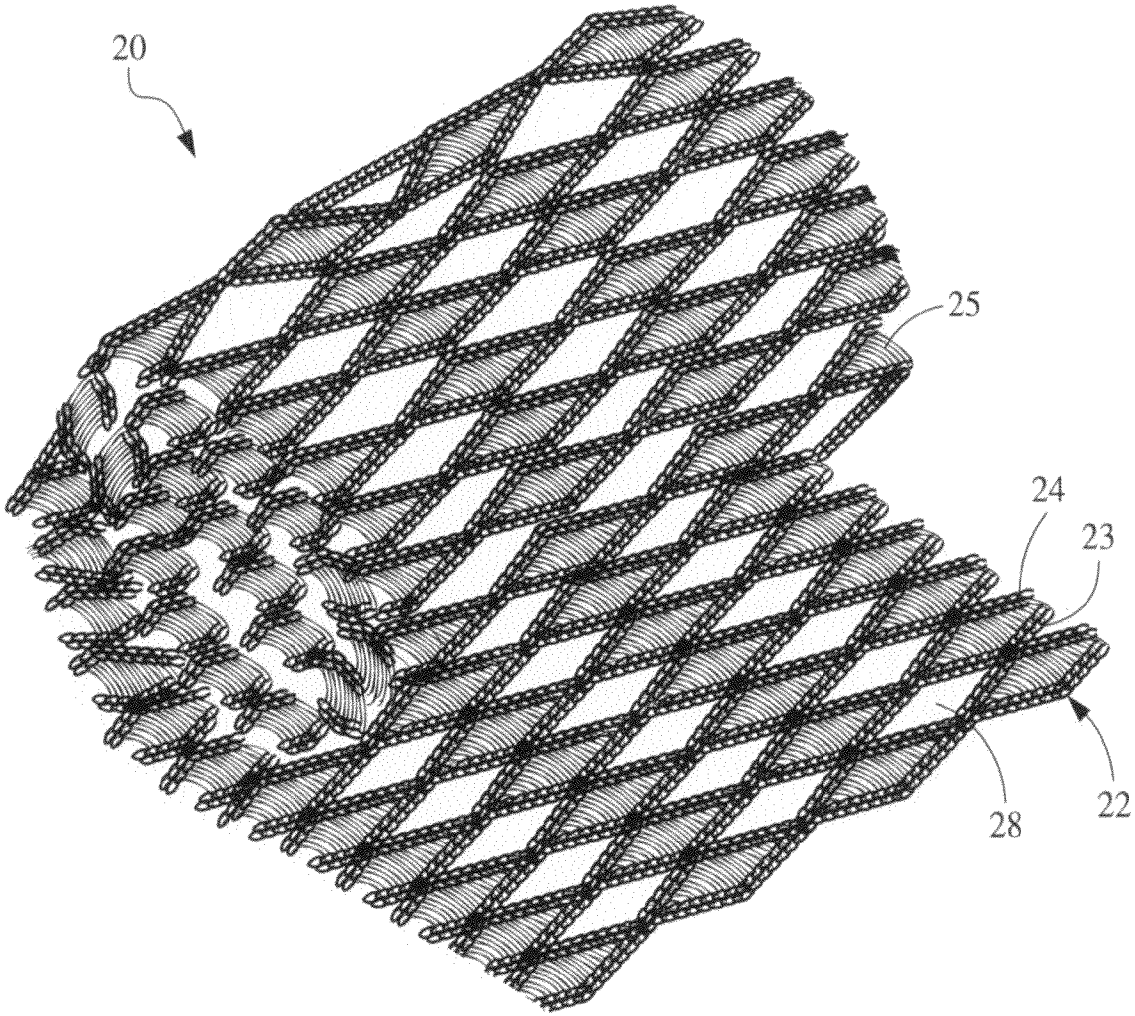
FIG. 6 shows the engineering-purpose netted vegetation blanket of the present invention being wound into roll form for storage.

As can be seen in FIG. 6, the engineering-purpose netted vegetation blanket 20 of the present invention can be wound into roll form for storage and/or transport. Since the netted vegetation blanket 20 is produced using specific machines, the mesh units 22 have sufficient shape restoring ability to allow longitudinal and transverse stretch thereof, and the curved thin threads 25 have sufficient flexibility and elasticity to maintain their protruding structure even when the netted vegetation blanket 20 is wound into roll form and then unwound for use. Therefore, the engineering-purpose netted vegetation blanket 20 of the present invention can be conveniently wound into roll form for storage and transport, and unwound and stretched for spreading on the earth surface. The drawbacks of the conventional fixedly shaped 3D netted vegetation blanket, such as not allowing convenient transport and tending to become flattened during construction, can be overcome.

The engineering-purpose netted vegetation blanket 20 of the present invention has an overall structure that provides sufficient softness and flexibility to enable convenient winding and transporting; the two-layer mesh units 22 thereof have borders knitted with thick threads to thereby have sufficient softness and elasticity for providing not only framing and supporting functions, but also good stretchability in both transverse and longitudinal directions; and the curved thin threads 25 provide a soft but dense enough structure, which allows easy attachment of sown seeds and covered soil thereto and provides sufficient spaces to help in the growth of the sown seeds on the netted vegetation blanket 20. Further, the voids 28 among the mesh units 22 provide the advantages of allowing easy growth of the sown seeds and facilitating easy spreading of the blanket, spray planting, and composting.

Therefore, the engineering-purpose netted vegetation blanket of the present invention is very suitable for protecting surface soil against erosion and preventing grass and plants from being washed away. Once the roots of grass and plants become tangling with the netted vegetation blanket and get deep down into the soil, the netted vegetation blanket forms a protection with full flexibility to the grass and plants.

What is claimed is:

1. An engineering-purpose netted vegetation blanket, comprising a plurality of mesh units arrayed and interwoven into rows; the mesh units each having borders loop-knitted using threads to form a double-layer structure including an upper thread layer and a lower thread layer so that the borders serve as a structural frame; a plurality of curved threads are woven to locate between the upper and lower thread layers and are sequentially arrayed and extended between two adjacent borders while protruding from a plane defined by the borders, the curved threads being devoid of interconnections therebetween within the mesh units; and the mesh units being arrayed in staggered relation, such that a void is formed between any two adjacent mesh units.

2. The engineering-purpose netted vegetation blanket as claimed in claim 1, wherein the mesh units each have one of a round shape and a rectangular shape.

3. The engineering-purpose netted vegetation blanket as claimed in claim 1, wherein the threads for knitting the mesh units are selected from the group consisting of yarn threads, Polyethylene threads, and High-Density Polyethylene threads.

* * * * *